US005975001A

United States Patent [19]

Verrier

[11] Patent Number: 5,975,001

[45] Date of Patent: Nov. 2, 1999

[54] ANCHOR

[76] Inventor: Jean-Pierre Verrier, Zone artisanale des Seizins, 17650 Saint-Denis-d'Oléron, France

[21] Appl. No.: 09/232,707

[22] Filed: Jan. 19, 1999

[30] Foreign Application Priority Data

Jan. 20, 1998 [FR] France ..... 98 00637

[51] Int. Cl.[6] ..... B63B 21/38

[52] U.S. Cl. ..... 114/304; 114/301

[58] Field of Search ..... 114/294, 301–306

[56] References Cited

U.S. PATENT DOCUMENTS 3,263,642 8/1966 Wilson .

3,977,351 8/1976 Watterback ..... 114/306

4,154,187 5/1979 Taylor et al. ..... 114/304

5,622,135 4/1997 Eberline, Sr. .

*Primary Examiner*—Ed Swinehart

*Attorney, Agent, or Firm*—Oblon, Spivak, McClelland, Maier & Neustadt, P.C.

[57] ABSTRACT

The present invention relates to an anchor for floating devices and includes a body provided with a shackle linked to an anchor chain, with one set member for engaging the bed of a body of water being jointedly mounted on said body. The body includes a first portion having two longitudinal ends and a second portion extending between the ends of the first portion and being spaced away so as to surround a void space therebetween. The shackle is slidingly mounted along the second portion and the set member is assembled on the first body portion in a jointed fashion to thereby be able to switch between set positions pointing oppositely from each other.

12 Claims, 7 Drawing Sheets

ANCHOR

FIELD OF THE INVENTION

The present invention is directed to anchors intended to anchor a floating device, such as a boat in particular.

BACKGROUND ART

A great number of anchor types are known such as a stock type anchor, a blade type anchor, and a flat type anchor, etc.

Many known anchor designs, in particular the blade type anchor, suffer from being hardly retrievable, i.e. they are frequently lost since one must disconnect the anchor from the boat in order to set the latter free.

By contrast, other anchors such as the flat type anchor, allow some degree of play which results In better release, but reset is difficult to achieve in case of a tidal change for instance.

SUMMARY OF THE INVENTION

In an attempt to overcome these disadvantages, the present invention is aimed at providing an anchor which allows easy release when desired, regardless of prevailing conditions, as well as a substantially constant hold even in case of a tidal change.

DETAILED DESCRIPTION OF THE INVENTION

Accordingly, one object of the present invention is to provide an anchor for a floating device comprising a body provided with a shackle linked to an anchor chain, one set portion for engaging the bed of a body of water being jointedly mounted on said body, wherein said body comprises a first portion having longitudinal ends and a second portion extending between both ends of the first portion and being spaced away so as to surround a void space therebetween, the shackle being slidingly mounted along said second portion and wherein the set portion is mounted on the first body portion in a jointed fashion to thereby be able to switch between set positions pointing oppositely from each other.

Other features are given herein below: and include the fact that

- the first and second body portions are elongate flat portions,
- the first and second body portions are generally coplanar,
- common ends of the first and second body portions each form a stop which prevents the shackle from sliding along the first body portion,
- the first body portion has an elongate flat triangular shape having a base connecting the longitudinal ends and an opposite vertex angle ranging from 150 to 170°, the second body portion being arch-shaped and oppositely extending from the vertex with respect to the base,
- the vertex angle of the triangle-shaped first body portion is 160°,
- the set portion Is pivotally mounted around an axis transverse to the general plane of the first body portion and intersecting the same, substantially In its middle portion,
- the set portion Includes two blades extending symetrically with respect to a plane passing by the X—X rotational axis, and defining an angle with this plane ranging from 70 to 80°, preferably equal to 75°, with both blades forming a common edge parallel to the rotational axis, and
- the common edge Is located virtually at the top of the first triangle-shaped first body portion.

BRIEF DESCRIPTION OF THE FIGURES

The present invention will now be described by way of example, with reference to the appended drawings, in which.

DETAILED DESCRIPTION OF THE FIGURES

Figure 1:
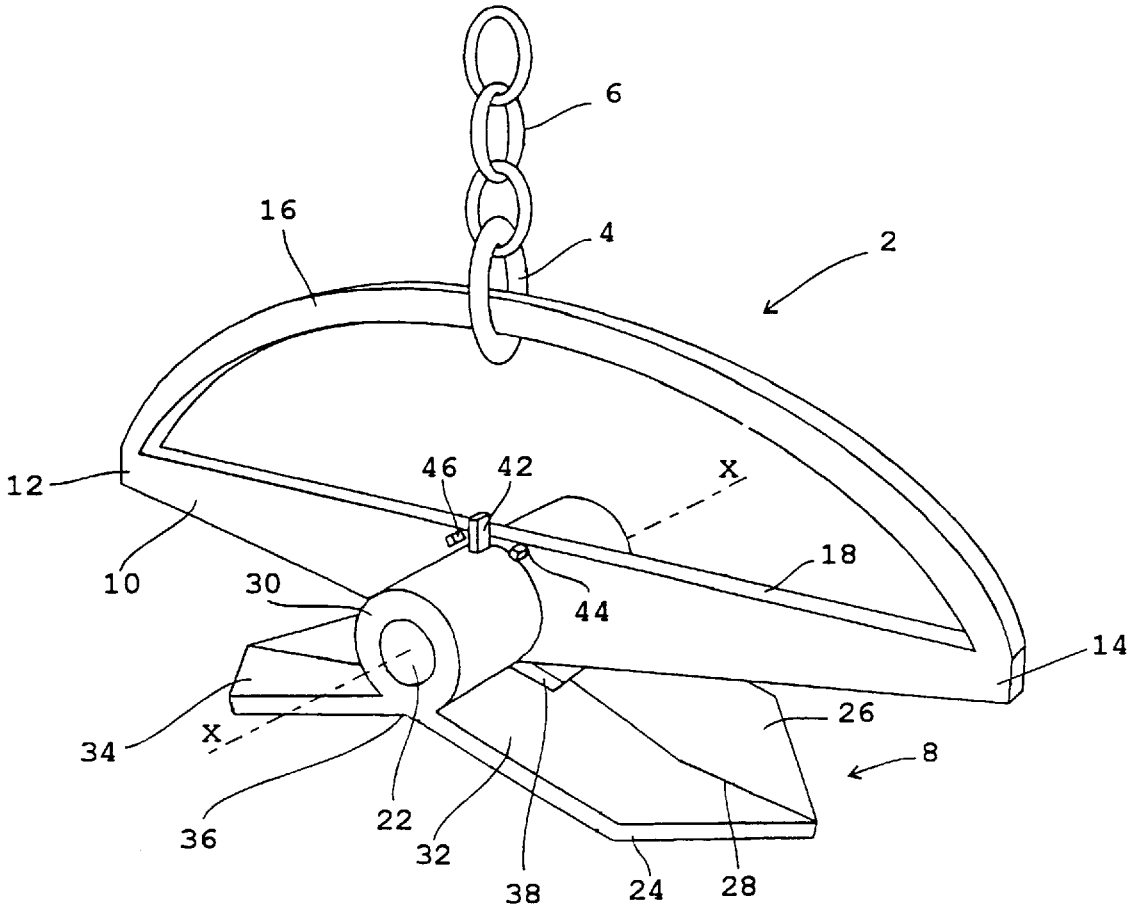
FIG. 1 is a perspective view representing a currently preferred embodiment of an anchor in accordance with the present invention, in the resting position, FIG. 2 Is a side view of the anchor of FIG. 1.

In FIG. 1, there is represented an anchor according to the present invention which comprises a body 2 bearing a shackle 4 linked to the first end of an anchor chain 6. The other end of the chain (not shown) is connected to a fixed point located on a floating device (not shown), such as a boat, directly or indirectly by means of rope, as is usually the case.

Body 2 further includes a set portion 8 which is pivotally mounted thereon, this set portion being designed to dig into the bed of a body of water or to grip a rocky cleft or lodge under a rock, as in typical situations.

According to the present invention, body 2 Includes a first body portion 10, of a generally elongate shape, the longitudinal ends of which 12, 14 are interconnected by means of a second body portion 16 following a longitudinal arrangement, which second body portion is spaced away from the first body portion 10 and coplanar thereto and equally terminates at longitudinal ends 12 and 14.

These two portions of bodies 10 and 16 define therebetween a void space, as can be seen on FIG. 1.

The shackle 4 is slidingly arranged along the second body portion 16 located between ends 12 and 14 which are common to both body portions.

The dimensions of shackle 4 and of ends 12 and 14 are so chosen to act as stops to thereby prevent the shackle 4 from sliding along the first body portion 10, upon reaching either one of ends 12 and 14, after sliding along the second body portion 16.

The set portion 8 is jointedly mounted on the first body portion 10, about the X—X rotational axis (see also FIGS. 3 and 4) transversely intersecting the general plane of the first body portion 10 at a point substantially mid way of ends 12 and 14.

Figure 2:
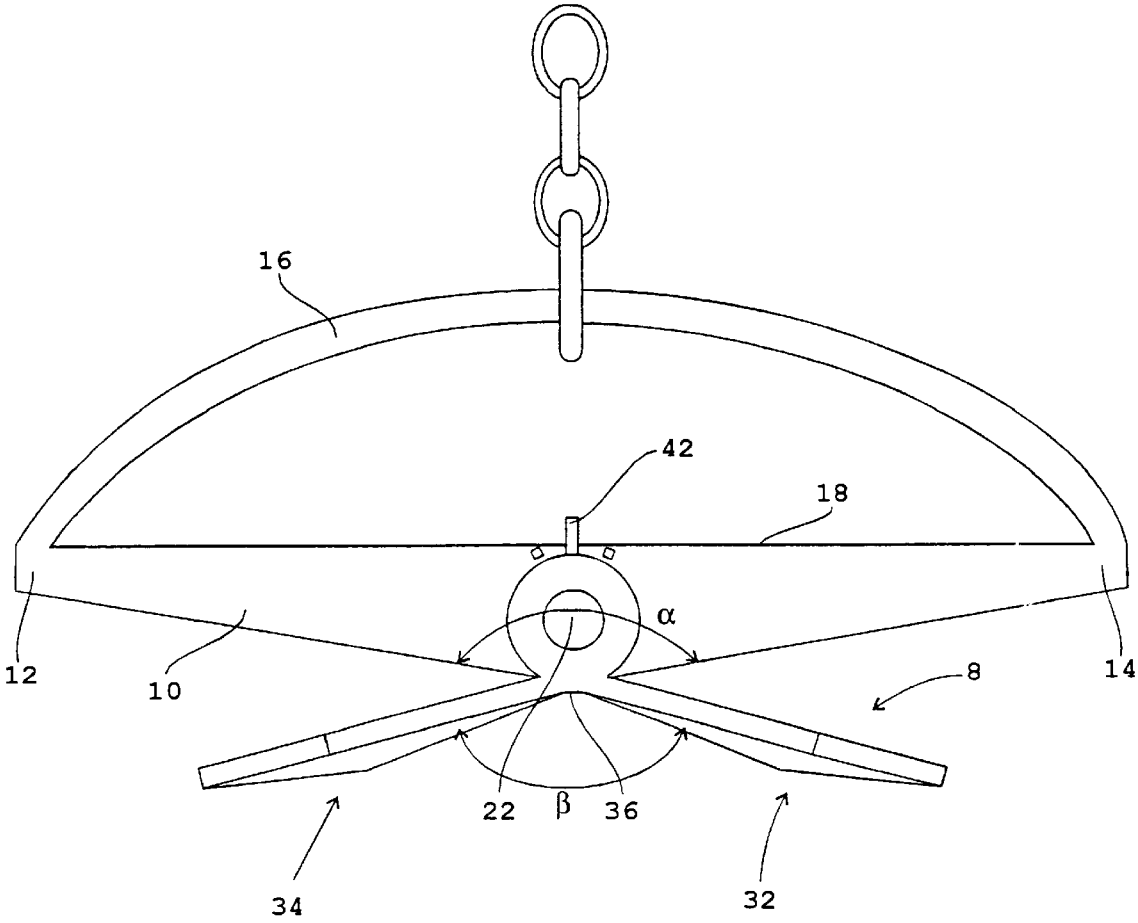
Figure 3:
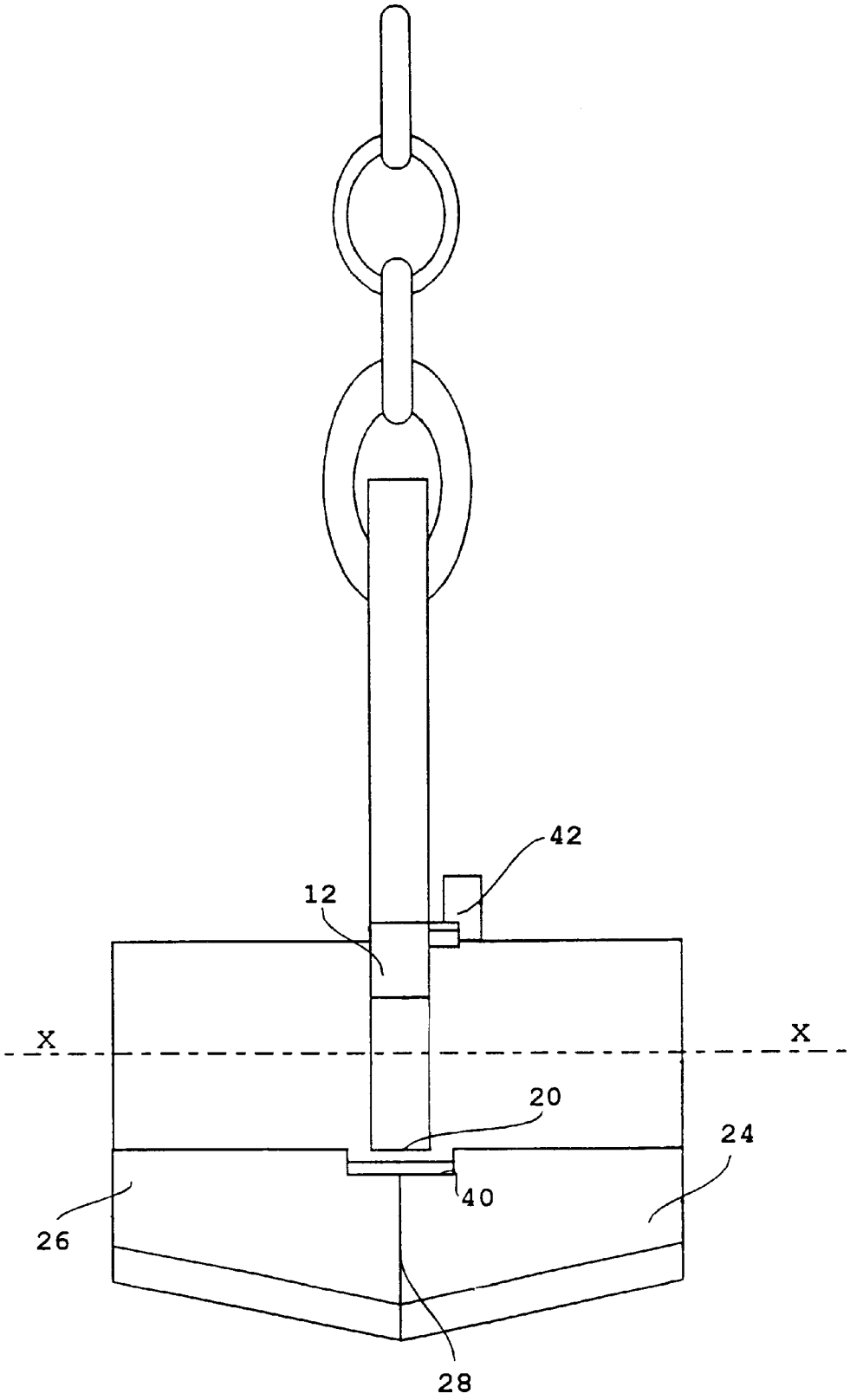
FIG. 3 is a lengthwise end view of the anchor of FIG. 1.

In a currently favored embodiment of the present invention, as shown on FIGS. 1 to 7, the first body portion 10, a side view of which is given on FIG. 2, has generally the shape of a triangle with its base 18 interconnecting ends 12 and 14 and its vertex 20 pointing opposite the second body portion 16 with respect to the base 18, thus forming an edge on first body portion 10 (see FIG. 3).

Angle $\alpha$ of vertex 20 (see FIG. 2) ranges from 150° to 170°, being preferably equal to 160° as outlined on FIGS. 1 to 7.

It shall be noted that the thickness of body 2 Is very small as compared to the length thereof, since the weight of body 2 plays only a minor role when operating the anchor, as will be further described hereinbelow.

In this preferred embodiment, the set portion 8 is pivotally mounted around a shaft 22 arranged along the X—X axis, the exact position of this axis in relation to the triangle vertex being set forth below.

This shaft 22 may be formed of two half shafts being aligned on either side of the first body portion 10, or may be a single shaft extending all the way through.

The set portion 8, as such, is comprised, as shown in this preferred embodiment, of two symetrical half blocks 24 and 26 which, during assembly, are interconnected by a weldline 28 (see FIGS. 1 and 3).

Referring to this symetrical configuration with respect to the weldline 28, only half block 24 shall be described hereinafter.

Half block 24 includes a cylindrical sleeve 30 the Inner diameter of which closely matches the outer diameter of shaft 22, so as to rotate freely when mounted around the shaft.

The outer diameter of sleeve 30 is so chosen that the outer surface thereof nearly passes across vertex 20 of the first body portion 10.

Stated otherwise, this arrangement determines the position of the X—X axis in relation to the vertex 20, the distance therebetween being equal to the sum of the radius of shaft 22 and the thickness of sleeve 30.

It shall be noted that sleeve 30 does not extend to the radial plane including weldline 28, the distance between this plane and said sleeve being at least equal to one half of the thickness of body 2.

The half block 24 of the set portion 8 includes two half blades 32 and 34 (see FIGS. 1 and 4) which are both virtually tangent to a generating line 36 of the outer surface of sleeve 30, and extend from either side thereof, so as to form an internal angle ranging from about 140 to 160°, preferably equal to 150° (see FIG. 2).

Figure 4:
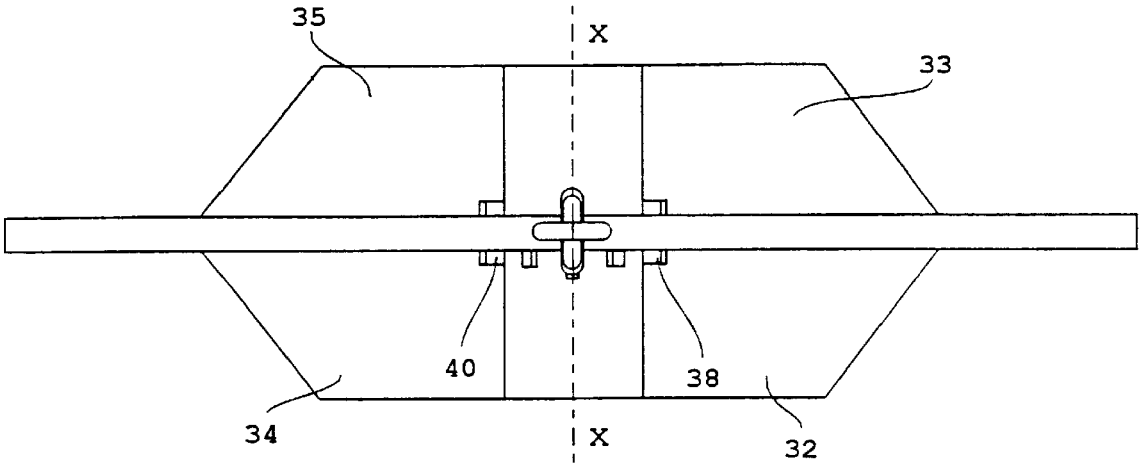
FIG. 4 is a top view of the anchor of FIG. 1.

Likewise, the half block 26 of the set portion 8 includes two half blades 33 and 35, to thereby yield, once assembled, two blades 32, 33 and 34, 35 respectively (see FIG. 4).

These blades have a length equal to approximately one third of the anchor length.

Each half blade 32 and 34 includes a notch 38 and 40, respectively.

Each notch 38 or 40 extends longitudinally from generating line 36, with its largeness as measured from the weldline 28 being greater to one half of the thickness of the first body portion 10 (see FIGS. 3 and 4).

Figure 5:
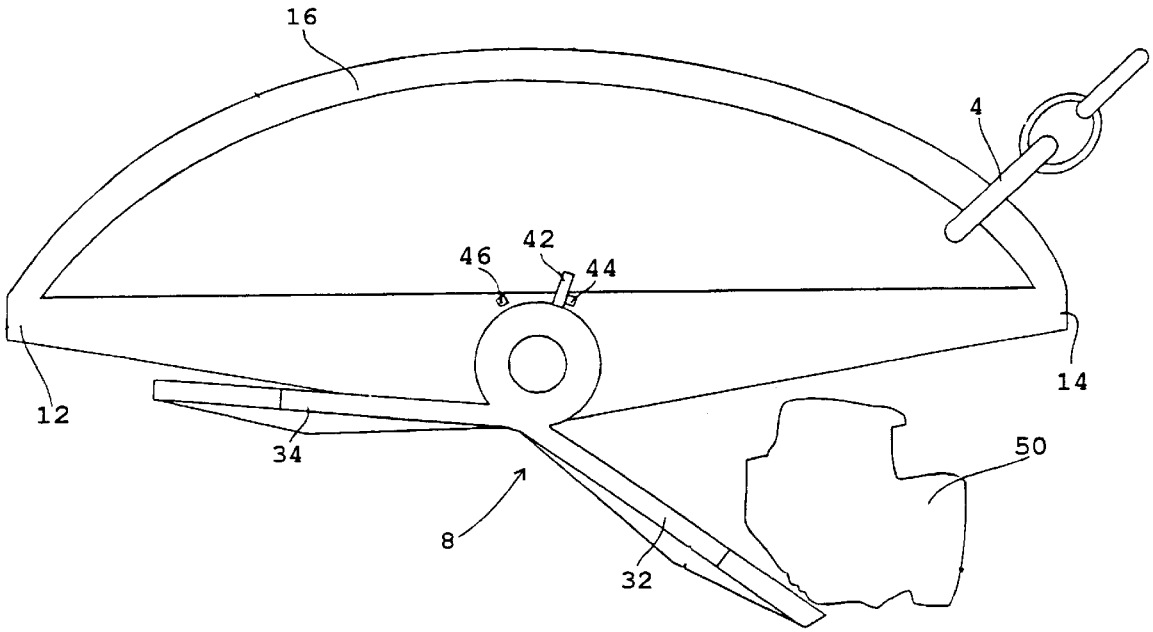
FIG. 5 is a drawing analogous to FIG. 2, the anchor of the present invention being shown in its set position.

The length of each notch is so chosen that when rotated by about 20° around the X—X axis (see FIG. 5), the set portion 8 does not interfere with the first body portion 10 (especially the half block of blade 34 in the example given at FIG. 5).

The exact length thereof may be readily determined by the skilled artisan In the field.

Moreover, the sleeve 30 of only half block 24 of the set portion includes a projection 42 located close to its terminal portion near the radial plane passing across weldline 28, along the outer generating line lying oppositely to generating line 36.

This projection 42 Is Intended to interact with two stops 44 and 46 located at the surface of the first body portion 10 which is facing half block 24.

It shall also be noted that this assembly can also be located on just half block 26 or even both half blocks.

Stops 44 and 46 limit the rotation of projection 42, and thus of the set portion 8, around the X—X axis up to a maximum angle of 40°, i.e., 20° at either side of a plane passing across the X—X axis and the vertex 20 of the first body portion, such a plane forming a symetry plane across the set portion.

It shall be noted that once sleeve 30 of each half block of the set portion Is assembled, both half blocks are joined along weldline 28, to form a single construction. Thus, each blade is shovel-shaped and has a tip portion, analogous to known shovel type anchors.

However, this particular form is not basically important to the present invention and can be modified by those skilled in the art without departing from the scope of the appended claims.

It shall be equally noted that the weight of the set portion 8 is clearly greater that the weight of body 2, such that when the anchor is dropped into the water, it will travel down in the resting state Illustrated on FIG. 2.

Subsequently, once the anchor strikes the bed of a body of water, the tips of each blade provide support to the former as they may be slightly driven downward to adopt a standby position, in the resting state.

The chain will then adopt its natural configuration i.e. draw up a curve line which, as seen when moving away from the anchor, is nearly tangent to the bed of a body of water and extends all the way up to floating device.

When this natural configuration occurs, the shakle 4 slides along the second body portion 16, nearly all the way to either one of ends 12, 14.

Let us consider now the case where said end is end 14, as shown on FIG. 5.

In this state, the chain pulling back the shackle will withdraw the anchor causing it to scrape the bed and causing the set portion 8 to rotate around the X—X axis by an angle of 20° at most due to the action of stops 44 and 46, thus activating blade 32 and 33.

Stated otherwise, the blade 32, 33 will dig into the loose bottom or penetrate into a cleft or still cling to a rock 50 as shown In FIG. 5.

It shall be noted that the triangular shape of the first body portion 10 widens the gap where a rock can fit.

From this point, illustrated at FIG. 5, when a tidal change or current reversion occurs, the shackle 4 will be driven by the chain 6 to slide along the second body portion 16 toward end 12.

Figure 6:
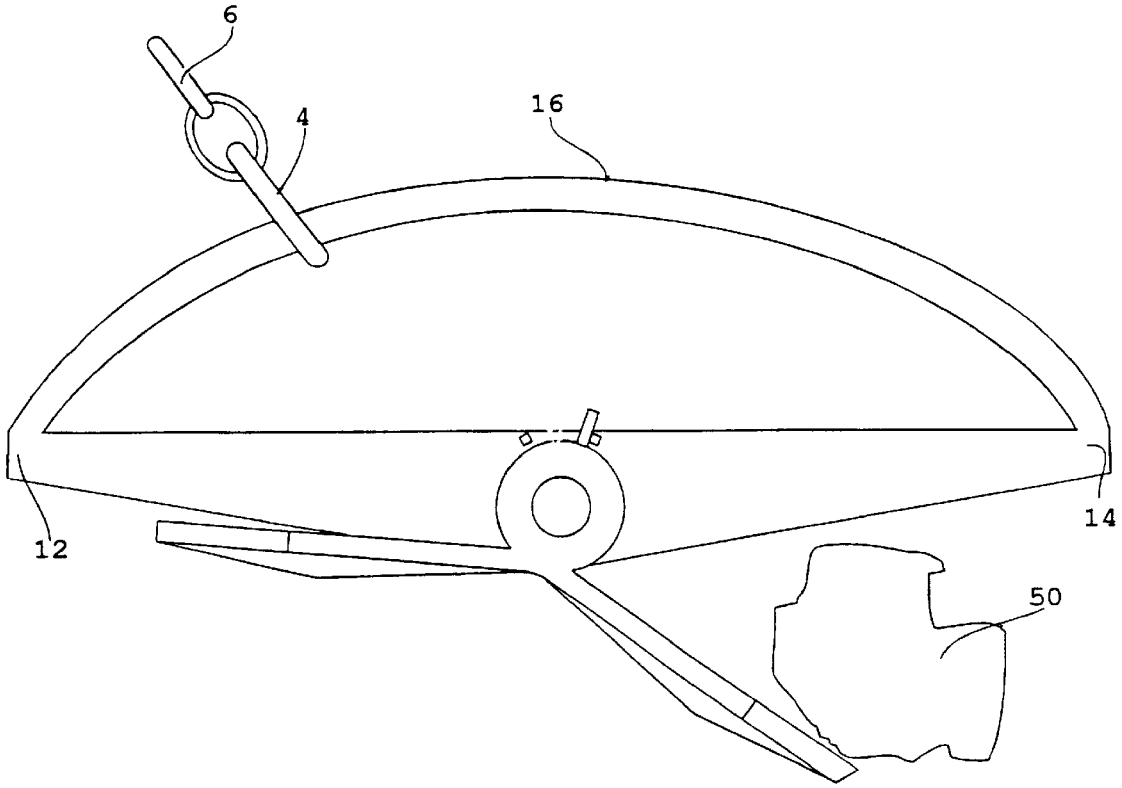
FIG. 6 is a drawing analogous to FIG. 5, with the shackle being shown in a configuration where the set portion is in a release position, as a result of deliberate action or a tidal change.
Figure 7:
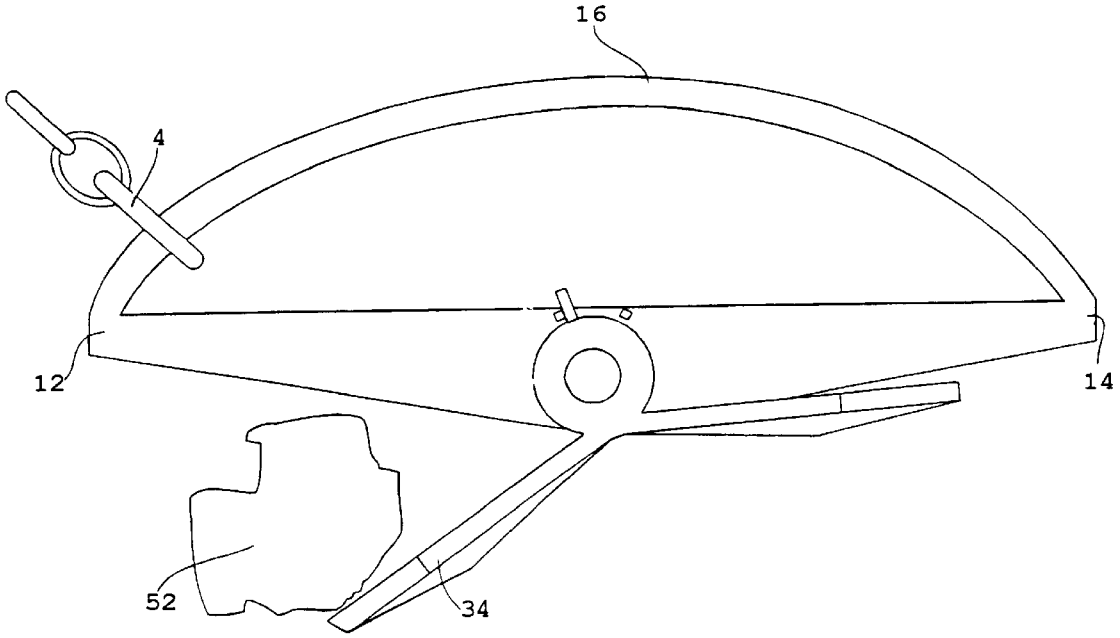
FIG. 7 represents the anchor in accordance with the present invention in a set position opposite the set direction of FIGS. 5 and 6.

At some point during its sliding course, the shackle 4 will exert traction on anchor 2 along the general plane of active blade 32, 33, in a direction which abolishes setting, such a state being represented by FIG. 6.

In this situation, the tensile force exerted on the anchor has a very strong component In the plane of blade 32, 33, which fact will insure its release.

Shackle 4 will continue to slide until reaching end 12 and reset as depicted hereinabove will occur, the active blade being now blade 34, 35 (see FIG. 7) through Interaction for example with another rock 52.

Stated otherwise, anchor 2 according to the invention is considered as non-fouling since when retrieving the anchor, by withdrawing the anchor equipment, the boat will move till it lines up vertically above the anchor, shackle 4 moving then back to the middle of second body portion 16.

In this state, the blades drawn upwards are dislodged easily even though either one may be tightly gripped by a rock or a layer of stone, since there exists a force component opposite that of the holding force being exerted.

This may be even enhanced by the sliding of the shackle which results in narrowing of the gap between the active blade and the first body portion 10, giving rise to an edge effect which further promotes the release of the anchor.

On the other hand, in case of a tidal change, there may be very transient grip loss as resetting occurs almost instantly.

Although the present Invention has been described by reference to the best way of practice currently known, it shall be noted that numerous changes can be conceived without departing from the scope of the Invention as set forth in the appended claims.

For example, projection 42 may be mounted on the first body portion 10 and stops 44, 46 may be then be assembled on anyone of sleeves 30.

Furthermore, another construction can be devised where It is easier to change the set portion. In this case, shaft 22 is replaced by a bolt extending through first body portion 10 and a nut, thereby fusing both blades into an integral block.

In such a case, the set portion can be easily assembled and disassembled.

Instead of making half blades so to be subsequently joined together by welding, one can construct integrated blades (corresponding to blade 32, 33 or to blade 34, 35) and fix sleeves 30 thereon by welding after positioning the same around shaft 22.

What is claimed is:

1. An anchor for a floating device comprising:

i) a body forming in a body plane a first longitudinal portion extending between two opposite longitudinal ends of said body, and a second arcuate portion having an arch-shape extending from the one to the other of said longitudinal ends of said body, thereby delimitating a void space between said first and said second portion, ii) a shackle for coupling said body with one of an anchoring line and a chain, said shackle being slidably mounted on said second portion, iii) and a set number pivotably mounted on said first portion and comprising two symmetrical blades, said set member being pivotably mounted on said first portion of said body around an axis transverse to said body plane so as to be switchable between two set positions in respective opposite directions.

2. An anchor according to claim 1, wherein said first and second portions of said body comprise elongated flat portions.

3. An anchor in accordance with claim 1, wherein said first and second portions of said body comprise substantially flat portions coplanar in said body plane.

4. An anchor in accordance with claim 1, wherein said longitudinal ends of said body each form a stop for preventing the shackle from sliding out of said second portion along said first portion.

5. An anchor in accordance with claim 1, wherein said first portion of said body has an elongated, flat triangular shape with a straight base connecting longitudinal ends and an opposite vertex angle, said second portion of said body being arch-shaped and extending opposite said vertex with respect to said base.

6. An anchor in accordance with claim 5, wherein said vertex angle of the triangle-shaped first portion is in a range of from 150 to 170°.

7. An anchor in accordance with claim 1, wherein said axis around which said set portion is pivotably mounted intersects said body plane at a point located in a mid portion of said first portion.

8. An anchor in accordance with claim 7, wherein said two symmetrical blades in said set member are inclined with respect to their plane of symmetry including said axis around which said set portion rotates by an angle ranging from 70 to 80°.

9. An anchor in accordance with claim 1, wherein said blades have a common edge along which said blades are integral with a sleeve rotatably mounted on a shaft along said transverse axis wherein said sleeve is provided with a projection cooperating with two stops provided on said first portion of said body to limit rotation of said set member at said respective set positions.

10. An anchor according to claim 1 wherein each said blade comprises two half blades symmetrical with respect to said body plane, said blades being integral with a cylindrical sleeve mounted for free rotation on a shaft of said first portion of said body transverse to said body plane, and wherein said half blades have notches enabling said set member to avoid interfering with said first portion of said body upon rotation and switching of said set member between said set positions.

11. An anchor according to claim 10, wherein said two half blades have a length approximately one third of the anchor length between said longitudinal ends.

12. An anchor according to claim 10, wherein said sleeve is provided with a projection cooperating with two stops provided on said first portion of said blade to limit the rotation of said sleeve around said shaft to said set positions.

* * * * *